United States Patent [19]

Holtzer

[11] Patent Number: 5,009,365

[45] Date of Patent: Apr. 23, 1991

[54] REMOVABLE COIN STORAGE RECEPTACLE FOR SLOT MACHINES

[76] Inventor: Dominique Holtzer, 7,rue Moncey, 25000 Besancon, France

[21] Appl. No.: 277,173

[22] Filed: Nov. 29, 1988

[30] Foreign Application Priority Data

Dec. 8, 1987 [FR] France ..... 87 17040

[51] Int. Cl.[5] ..... G07B 15/00

[52] U.S. Cl. ..... 232/16; 232/15

[58] Field of Search ..... 232/16, 15, 1 D

[56] References Cited

U.S. PATENT DOCUMENTS

| | | | |
|---|---|---|---|
| 2,580,752 | 1/1952 | Forester . | |
| 3,083,896 | 4/1963 | Cairelli et al. . | |
| 3,206,111 | 9/1965 | Labe | 232/15 |
| 3,292,849 | 12/1966 | Ewing | 232/15 X |
| 3,837,566 | 9/1974 | McGough | 232/15 |
| 3,926,366 | 12/1975 | Sciortino | 232/15 |
| 3,948,376 | 4/1976 | Roman | 232/15 X |
| 4,729,509 | 3/1988 | Diekhoff | 232/16 |

*Primary Examiner*—Robert W. Gibson, Jr.

[57] ABSTRACT

The receptacle includes a coin insertion slot (32). The slot (32) may be closed by a flap (40) which is fixed to a bolt (34) having one end (46) capable of moving out from the receptacle in order to lock the receptacle in a slot machine. The bolt (34) is capable of being moved by means of a knob (42), and a latching mechanism (52) holds the bolt in its retracted position with the coin slot (32) closed by the flap (40) after the bolt has once been moved out into its locking position, thereby ensuring that the coin slot of a full coin receptacle remains locked until the receptacle is itself unlocked by a person authorized to do so, e.g. by means of a key.

6 Claims, 4 Drawing Sheets

FIG. 1a
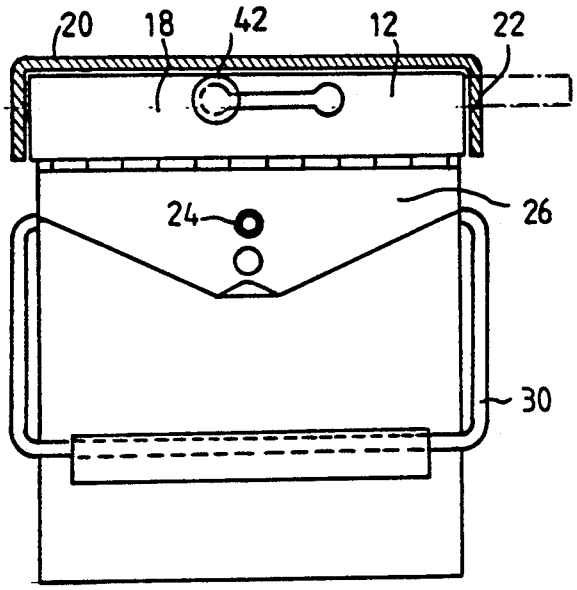
FIG. 1b
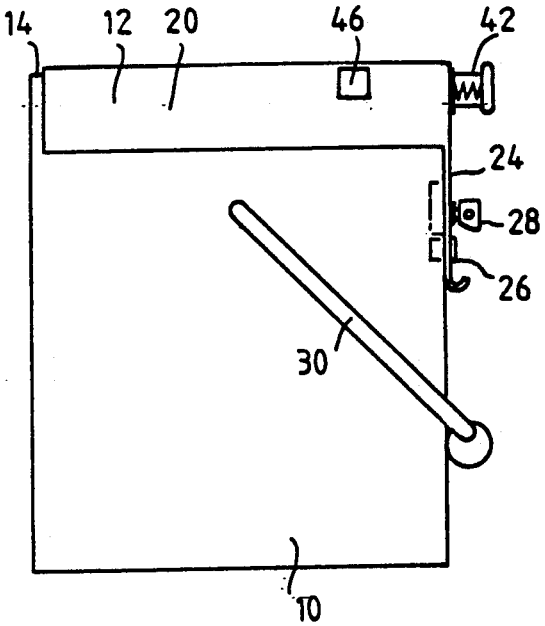
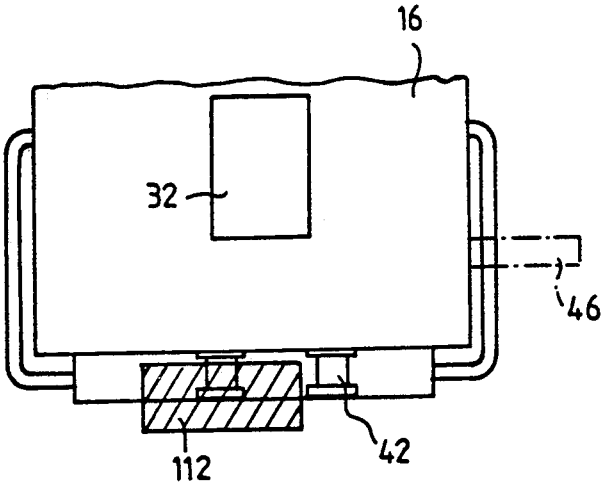
FIG. 1c
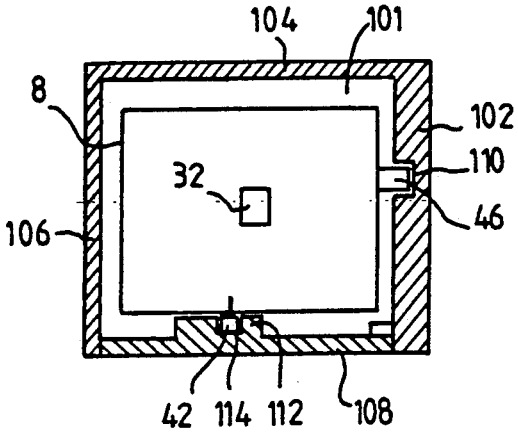
FIG. 7

REMOVABLE COIN STORAGE RECEPTACLE FOR SLOT MACHINES

The present invention relates to a removable coin storage receptacle for slot machines, i.e. machines actuated by having coins inserted therein.

BACKGROUND OF THE INVENTION

It is necessary to provide a receptacle in slot machines for storing the machine-actuating coins inserted therein over a period of time until a person employed to maintain the machines comes and collects the coins stored in this way.

Two main types of receptacle can be envisaged: those which are fixed relative to the machine and those which are removable. Fixed receptacles are provided with a coin collecting orifice which is normally closed by a shutter. Coins are collected by moving the shutter in order to open the coin collecting orifice. When removable receptacles are used, coin collection is performed by extracting a receptacle full of coins and replacing it with an empty receptacle. The present invention relates to removable receptacles.

In order to provide full security, such receptacles must satisfy various conditions. While the receptacle is being transported, it is necessary to keep closed the slot via which the receptacle receives coins and for it to be impossible for the person doing the collection to open the slot. In addition, when a receptacle is inserted in the corresponding compartment in a slot machine, it is important that the operation which serves to open the coin insertion slot in the receptacle should also lock the receptacle to the machine.

An object of the invention is to provide a removable coin receptacle satisfying the above conditions, and which is both simple and robust in construction in order to provide security during receptacle utilization.

SUMMARY OF THE INVENTION

The present invention provides a removable coin storage receptacle for slot machines, the receptacle comprising: a housing provided with a slot in one of its faces for receiving coins; means mounted inside said receptacle and capable of moving in translation, said means including a bolt having a locking end and a flap fixed to said bolt and suitable for closing said slot; operating means projecting from said receptacle and constrained to move in translation with said bolt in order to move said moving means into a first position in which said slot is left open and said locking end of the bolt projects out from said housing in order to enable said receptacle to be locked to said slot machine, or into a second position in which said flap closes said slot and in which said locking end is retracted so as not to project out from said housing; and a latching mechanism distinct from said operating means and co-operating with said moving means for enabling said moving means to be moved initially from said second position to said first position; and subsequently enabling said moving means to be moved back from said first position to said second position; said moving assembly then being prevented by said latching mechanism from returning to said first position until after said latching mechanism has been acted upon by using controlled access means.

It will be understood that when such a receptacle is inserted in a slot machine, the moving assembly is moved into its first position, thereby opening the coin insertion slot and locking the receptacle to the machine. In order to extract a full receptacle from the machine, the moving assembly must be moved back into its second position, thereby closing the slot. After this has been done, the moving assembly cannot be moved again into its first position without having access to the controlled access means, e.g. a key, for opening the receptacle.

Preferably, the controlled access means are constituted by the receptacle including a removable cover which is closed by locking means which are accessible from outside the receptacle.

Also preferably, said latching mechanism includes a moving latch suitable for moving perpendicularly to said moving means and a plate which is pivotally mounted on one end of said bolt, with said bolt including an orifice through which said latch can penetrate when said bolt is in its second position, said plate closing said orifice under the effect of return means, said latch being suitable for moving said plate in order to penetrate into said orifice when said moving assembly passes from the second position to said first position.

BRIEF DESCRIPTION OF THE DRAWINGS

An embodiment of the invention is described, by way of example with reference to the accompanying drawings, in which:

FIG. 1*a* front view in partial section of a removable receptacle;

FIG. 1*b* is a left elevation view of the removable receptacle;

FIG. 1*c* is a fragmentary plan view of the removable receptacle;

FIG. 7 is a horizontal section showing how the removable receptacle is received in a slot machine.

MORE DETAILED DESCRIPTION

Figure 2A:
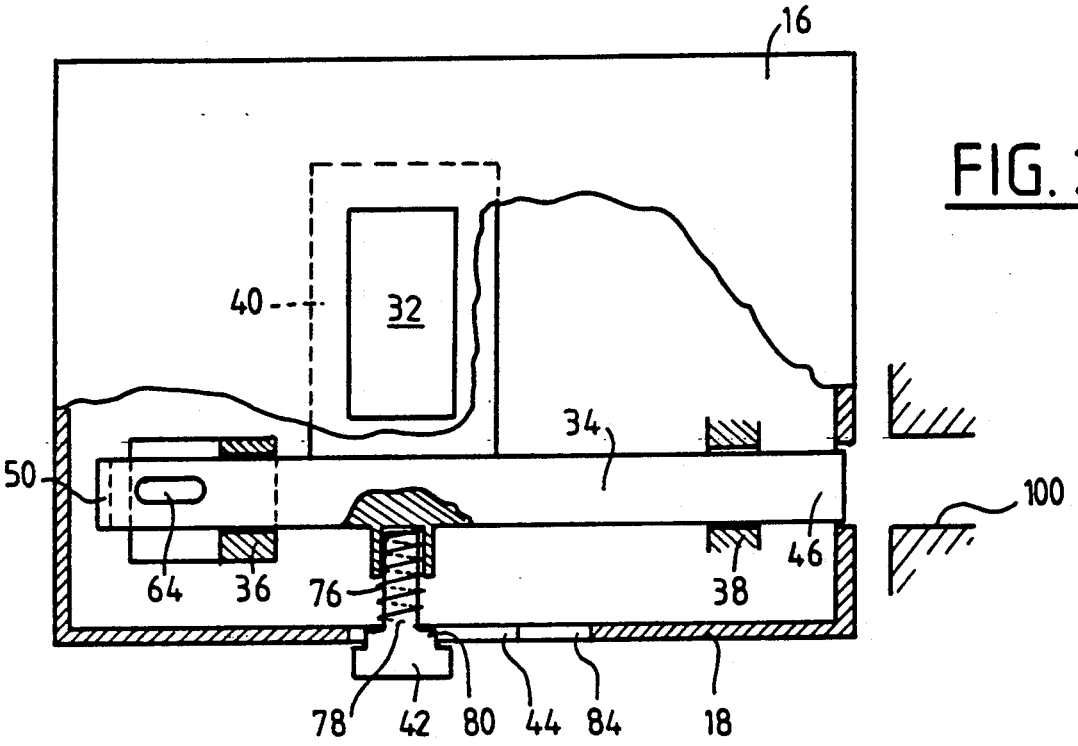
FIGS. 2*a* 2*b* are plan views in partial section showing the shutter member for shutting the coin insertion slot and for locking the receptacle in its operating position and in its transport position.

The outside of a removable receptacle is described initially with reference to FIGS. 1*a* and 1*c*. The receptacle comprises a body 10 which is generally rectangular in shape and is closed at the top by a cover 12 which is hinged to the body 10 by hinges 14. The cover 12 comprises a top wall 16, a front rim 18, and two side rims 20 and 22. The cover 12 is suitable for being retained in its closed position by a lock 24 mounted on a hasp 26 which is hinged to the front rim 18 of the cover 12. The lock 24 may be actuated by a key 28. In order to facilitate transporting the storage receptacle, it is provided with a handle 30.

As can be seen in FIG. 1*c*, the top wall 16 of the cover 12 is provided with a slot 32. When the receptacle is put into place in a slot machine, the coins accepted by the machine enter the receptacle via the slot 32 in the receptacle.

Figure 2B:
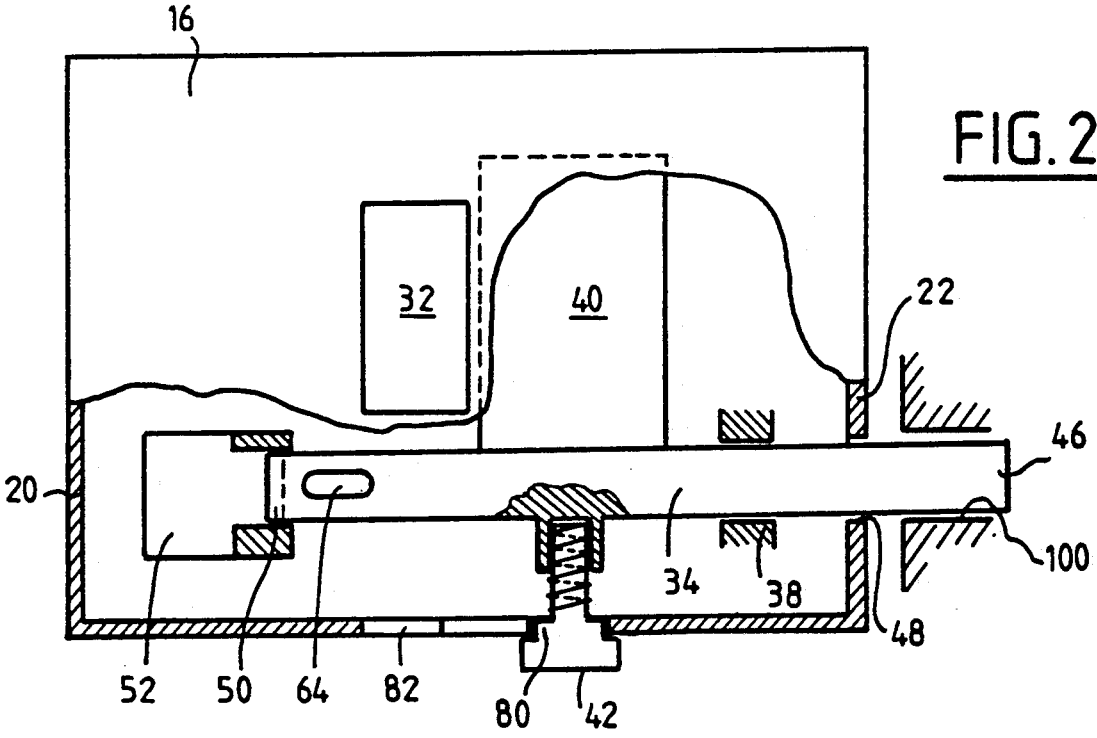
Figure 3:
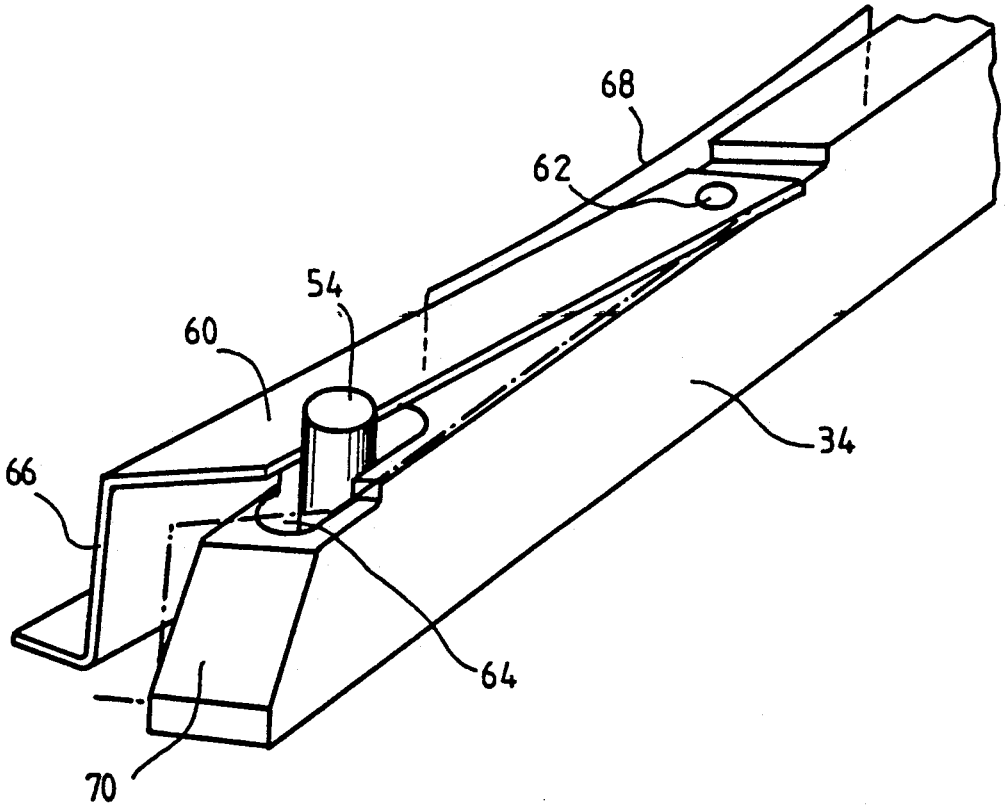
FIG. 3 is a perspective view of the mechanism for locking the shutter flap for closing the coin insertion slot.

Reference is now made to FIGS. 2*a* and 2*b* while describing the members which enable the coin insertion slot 32 to be closed and which also serve to lock the receptacle to a slot machine. These members comprise a rectangular cross-section bolt which is mounted on the inside face of the top wall 16 of the cover 12. The bolt 34 is free to move in translation along its axis XX' and it is guided by U-shaped pieces 36 and 38 which are fixed to the cover 12. These members also include a flap 40 constrained to move in translation with the bolt 34, and a control knob 42 also constrained to move in translation with the bolt 34 and which projects through the front rim 18 of the cover via a longitudinal slot 44.

The knob 42 can be used to move the bolt 34 and thus the flap 40 between a first or "transport" position as shown in FIG. 2*a* in which the flap 40 closes the slot 32 and the end 46 of the bolt 34 is retracted into the cover 12, and a second or "operating" position as shown in FIG. 2*b* in which the flap 40 leaves the slot 32 wide open and the end 46 of the bolt 34 projects out from the cover 12 and passes through an orifice 48 provided in the side rim 22 of the cover.

In order to make it possible to prevent the bolt 34 and the flap 40 from being moved away from the operating position into the transport position, or vice versa, the other end 50 of the bolt 34 co-operates with a latching mechanism 52 which is mounted in part on the inside face of the top wall 16 of the cover 12 and in part on the end 52 itself.

The latching mechanism 52 is described in greater detail with reference to FIGS. 3 to 6*b*. It is essentially constituted by a short plunger or latch 54 capable of moving along a direction YY' extending at right angles to the plane of the top wall 16 of the cover. The latch 54 is guided by a piece 56 which is fixed to the cover. A return spring 58 urges the end 54*a* of the latch 54 towards the top wall 16 of the cover. The mechanism 52 also includes a moving plate 60 pivotally mounted about an axis 62 which is fixed relative to the bolt 34. Close to its end 50, the bolt 34 includes an oblong hole 64 of sufficient size to enable the leading end 54*a* of the latch 54 to be engaged therein. The plate 60 is provided with a rim 66 which comes into abutment with the flank 34*a* of the bolt 34 under the effect of a return spring blade 68.

Figure 4A:
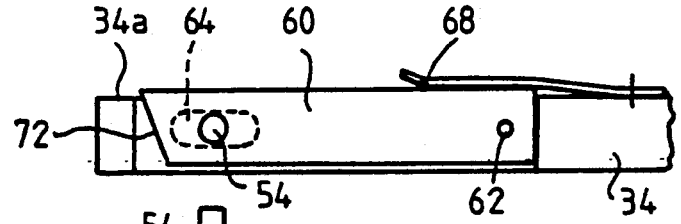
FIGS. 4*a*, 4*b*, 5*a*, 5*b*, 6*a*, and 6*b* are plan views (a) and vertical sections (b) showing the FIG. 3 mechanism in three different stable positions.
Figure 6A:
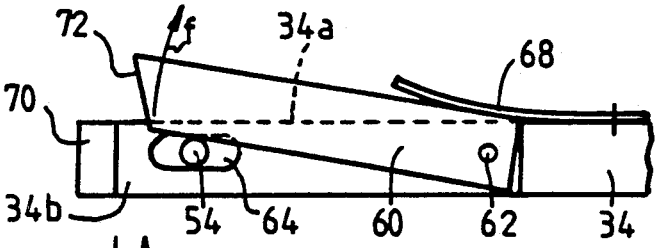

Thus, at rest, the plate 60 completely covers the hole 64 as can be seen in FIGS. 4*a* to 5*b*. The inside end of the bolt 34 is chamfered at 70 so as to enable the chamfered portion 70 to act as a cam surface for engaging the latch 54. Similarly, as can be seen in FIGS. 4*a*, 5*a*, and 6*a*, the free end of the plate 60 is also chamfered at 72.

As can be seen in FIGS. 2*a*, 2*b*, and 1*a*, the knob 42 for moving the bolt 34 is mounted on the bolt 34 by means including a return spring 76. The stem 78 of the knob 42 includes a larger diameter portion 80. The slot 44 along which the stem 78 of the knob 42 moves has two circular holes 82 and 84, one at each end, for receiving the larger diameter portion 80 of the stem 78 of the knob 42. Thus, when the knob 42 is in either of its two end positions as shown in FIGS. 2*a* and 2*b*, the knob 42, and thus the bolt 34, is not free to move under the effect of a shock or other accidental actuation.

Operation of the removable coin receptacle is now described with reference to FIGS. 2*a* to 6*b*.

Figure 4B:
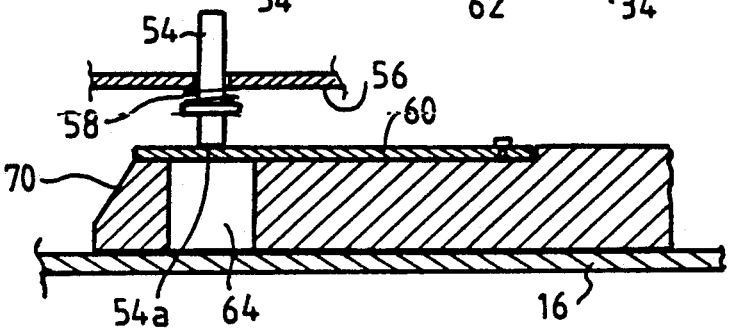
Figure 5A:
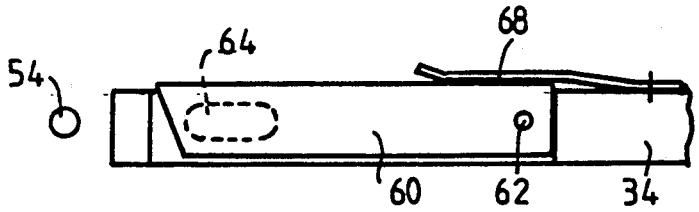
Figure 5B:
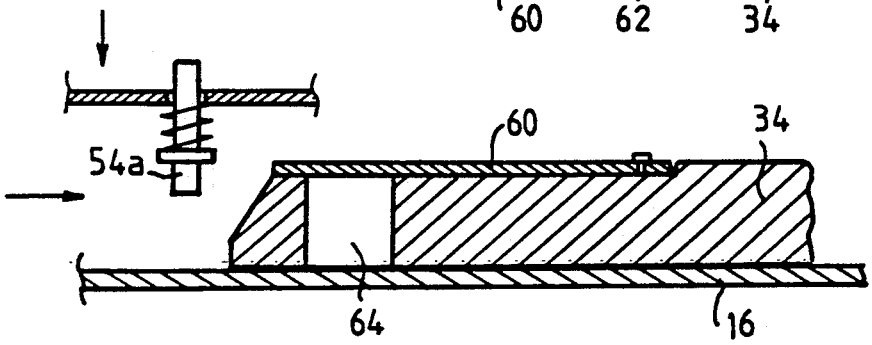

When the receptacle is empty and outside the slot machine in which it is to be inserted, the bolt 34 is in its transport position as shown in FIG. 2*a*, and the mechanism 52 is in its state shown in FIGS. 4*a* and 4*b*.

In other words, the flap 40 closes the slot 32 and the end 46 of the bolt 34 is inside the receptacle. The latching mechanism 52 is in the following position: the plate 60 covers the hole 64 and the leading end 54*a* of the latch 54 bears against the plate 60 under the effect of its return spring 58. The bolt 34 is thus prevented from moving in translation solely by the larger diameter portion 80 of the knob 42 co-operating with the hole 82.

When the receptacle is to be inserted in a slot machine, it is inserted into the appropriate housing of the machine, after which the knob 42 needs to be pulled a little way out from the receptacle and then moved sideways to bring the knob level with the second hole 84 (FIG. 2*b*). In this position, the coin slot 32 is no longer closed by the flap 40 and the end 46 of the bolt 34 projects out from the receptacle and penetrates into a socket 100 in the slot machine. It is therefore impossible to remove the receptacle from the machine without moving the knob 42 back again. Meanwhile, the mechanism 52 has moved into the state shown in FIGS. 5*a* and 5*b*. By virtue of the inside end 50 of the bolt 34 moving away therefrom, the latch 54 is urged towards the wall 16 of the cover 12 by its return spring 58. In this situation, the bolt 34 is prevented from moving solely by the larger diameter portion 80 of the knob 82 co-operating with the hole 84.

If it is now desired to extract the coin receptacle with its load of coins from the slot machine, the knob 42 must be moved back to the hole 82. The flap 40 then closes the coin slot 32 and the end 46 of the bolt 34 no longer projects out from the receptacle.

Figure 6B:
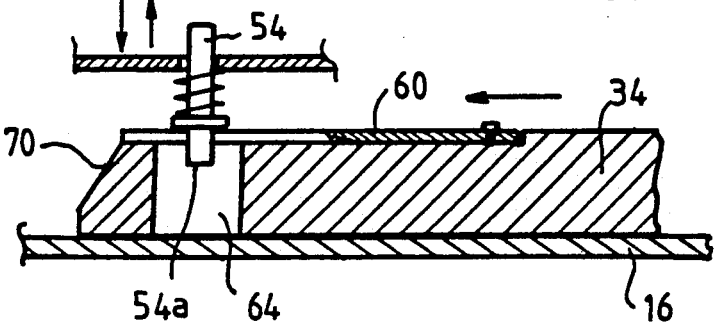

The corresponding movements of the mechanism 52 are described with reference to FIGS. 6*a* and 6*b*.

Under the effect of the bolt 34 being moved to the left, the leading end 54*a* of the latch 54 comes into contact with the chamfered portion 70 of the bolt, thereby moving the latch 54 vertically and compressing its return spring. When the end 54*a* of the latch 54 comes into abutment against the face 34*b* of the bolt 34 on which the plate 60 is mounted, and by virtue of the bolt 34 continuing to move to the left, the end 54*a* comes into contact with the chamfered end 72 of the plate 60 and tends to pivot the plate 60 in the direction of arrow f about the axis 62, thereby compressing return spring 68. The hole 64 is thus progressively disengaged until the end 54*a* of the latch 54 can penetrate into the hole 64, and this corresponds to the end of the stroke of the bolt 34.

In this position, the bolt 34 is thus locked by cooperation between the latch 54 and the hole 64. It is then impossible to use the knob 42 for attempting to reopen the coin slot 32.

In order to remove coins from the receptacle, it is necessary to have the key 28 for opening the cover 12.

In order to return the latching mechanism 52 to its initial position, as shown in FIGS. 4*a* and 4*b*, the latch 54 is merely pushed away by hand against the force of the return spring 58. The plate 60 is then no longer locked by the latch 54 and it returns to its rest position under the effect of its return spring 68. The hole 64 is thus again closed by the plate 60. When the latch 54 is released, its end comes into abutment against the plate 60 as shown in FIG. 4*a*.

FIG. 7 is a simplified diagram showing an example of how the receptacle 8 of FIGS. 1 to 6*b* can be received in a slot machine. The receptacle 8 is placed in a housing 101 delimited by walls 102, 104, and 106, and closed by a door 108. The wall 102 is provided with a socket 110 for receiving the end 46 of the bolt 34 when in its operating position. The door 108 includes a fixed part 112 on its inside face, said fixed part including a recess 114. The recess 114 is disposed in such a manner that when the operating knob 42 is in its operating position (FIG. 2*b*), the knob 42 can be received in the recess and the door can be closed, whereas if the knob is in any other position (FIG. 2*a*), the part 112 comes into abutment against the knob 42.

As a result, the door 108 of the slot machine can be closed only when the knob 42 is in its operating position, i.e. when the slot 32 is open and the receptacle 8 is locked in place to the machine.

Naturally, the coin insertion slot 32 could be disposed in a wall of the receptacle other than its cover, e.g. in its rear wall.

In the above-described example, coins can be emptied from the receptacle by opening the cover which is closed by means of a lock. Thus, in order to be able to remove the coins it is necessary to have the key which corresponds to the lock. It is also necessary to have this key in order to reset the mechanism 52.

In a variant embodiment of the receptacle, the receptacle does not have a cover and coins are extracted via the coin insertion slot 32. In order to facilitate guidance of the coins towards the slot while they are being extracted, the inside of the receptacle includes a hopper converging on the slot. The receptacle still includes the moving assembly 34, 40 and the latching mechanism 52. In order to make it possible to reset the mechanism 52, i.e. in order to make it possible to return the latch 54 and the plate 60 to their positions shown in FIGS. 4*a* and 4*b*, the free end of the bolt 54 co-operates with a mechanical assembly having an operating member which projects outside the receptacle. By acting temporarily on said operating member, it is possible to move the latch 54 and the bolt 34 away from each other temporarily so as to enable the plate 60 to return to its rest position with the end 54*a* of the latch 54 then pressing on the blade 60 again. In addition, the operating member is capable of being actuated solely by means of a key, for example. It will be understood that in this case also, access can be obtained to the coins and the mechanism 52 can be reset only if a controlled access means such as a key, for example, is available.

I claim:

1. A removable coin storage receptacle for slot machines, the receptacle comprising:

a housing provided with a slot in one of its faces for receiving coins;

means mounted inside said receptacle and capable of moving in translation, said means including a bolt having a locking end and a flap fixed to said bolt and suitable for closing said slot;

operating means projecting from said receptacle and constrained to move in translation with said bolt in order to move said moving means into a first position in which said slot is left open and said locking end of the bolt projects out from said housing in order to enable said receptacle to be locked to said slot machine, or into a second position in which said flap closes said slot and in which said locking end is retracted so as not to project out from said housing; and a latching mechanism distinct from said operating means and co-operating with said moving means for enabling said moving means to be moved initially from said second position to said first position; and subsequently enabling said moving means to be moved back from said first position to said second position; said moving assembly then being prevented by said latching mechanism from returning to said first position until after said latching mechanism has been acted upon by using controlled access means.

2. A removable receptacle according to claim 1, wherein said controlled access means comprise a cover capable of being fixed to the housing by second locking means.

3. A removable receptacle according to claim 2, wherein said slot is provided through said cover, and wherein said moving means are mounted on said cover.

4. A removable receptacle according to claim 2, wherein said latching mechanism comprises a moving latch suitable for moving perpendicularly to said moving means, and a plate pivotally mounted on the inside end of said bolt, said bolt including an orifice into which a first end of said latch can penetrate when said bolt is in its second position, said plate closing said orifice under the effect of return means, said latch being suitable for displacing said plate in order to penetrate into said orifice when said moving assembly moves from said second position to said first position.

5. A removable receptacle according to claim 3, wherein said latching mechanism comprises a moving latch suitable for moving perpendicularly to said moving means, and a plate pivotally mounted on the inside end of said bolt, said bolt including an orifice into which a first end of said latch can penetrate when said bolt is in its second position, said plate closing said orifice under the effect of return means, said latch being suitable for displacing said plate in order to penetrate into said orifice when said moving assembly moves from said second position to said first position.

6. A removable receptacle according to claim 5, in which said latch is provided with a return spring urging it to cause its leading end to penetrate into said orifice, and in which the other end of said latch is accessible only when said cover is open, thereby enabling said leading end of the latch to be disengaged from said orifice and thus enabling said plate to be returned to its position in which it closes said orifice.

* * * * *